United States Patent [19]

Takaishi

[11] Patent Number: 5,059,044

[45] Date of Patent: Oct. 22, 1991

[54] THERMAL PRINTER THAT DETECTS RATE OF TEMPERATURE INCREASE

[76] Inventor: Kazuaki Takaishi, Shizuoka, Japan

[21] Appl. No.: 365,089

[22] Filed: Jun. 12, 1989

[30] Foreign Application Priority Data

Jun. 15, 1988 [JP] Japan ..... 63-147381

[51] Int. Cl.[5] ..... B41J 2/375

[52] U.S. Cl. ..... 400/120; 400/54

[58] Field of Search ..... 400/120, 54, 124 TC; 346/76 PH

[56] References Cited

U.S. PATENT DOCUMENTS

| | | | |
|---|---|---|---|
| 3,777,116 | 12/1973 | Brescia et al. | 400/121 |
| 4,376,942 | 3/1983 | Toth | 400/120 |
| 4,540,295 | 9/1985 | Okunishi | 400/120 |
| 4,651,166 | 3/1987 | Katsuragi | 400/120 |
| 4,778,293 | 10/1988 | Teshima | 400/124 TC |

FOREIGN PATENT DOCUMENTS

| | | | |
|---|---|---|---|
| 3337950A1 | 5/1985 | Fed. Rep. of Germany | 346/76 PH |
| 58-104774 | 6/1983 | Japan | 400/120 |
| 58-201681 | 11/1983 | Japan | 400/120 |
| 59-4267 | 1/1984 | Japan | 400/120 |
| 59-4268 | 1/1984 | Japan | 400/120 |
| 199965 | 9/1986 | Japan | 400/120 |
| 189172 | 8/1987 | Japan | 400/124 TC |

*Primary Examiner*—David A. Wiecking
*Assistant Examiner*—Steven S. Kelley

[57] ABSTRACT

A ticket issuing device includes a thermal head, a temperature detector circuit for detecting the temperature of the thermal head, and a printing control circuit for driving the thermal head to repeatedly print boarding ticket information on paper a number of times, corresponding to the number of tickets to be issued, and issuing the printed paper as tickets. In the ticket issuing device, the printing control circuit derives a temperature difference between the temperatures detected by the temperature detector circuit before and after each printing operation, and uses the result as the rate of temperature increase of the thermal head, temporarily sets the thermal head into a non-active state for a period of time corresponding to a difference between the rate of the temperature rise and a reference value set to be higher than the rate of the temperature rise which will be attained in the course of the printing operation at normal printing density, when it is detected that the rate of temperature increase has exceeded the reference value and then starts the printing operation.

7 Claims, 5 Drawing Sheets

THERMAL PRINTER THAT DETECTS RATE OF TEMPERATURE INCREASE

BACKGROUND OF THE INVENTION

1. Field of the Invention

This invention relates to a ticket issuing device which issues a plurality of tickets as a single unit, and more particularly to a ticket issuing device having a thermal head for printing tickets to be issued.

2. Description of the Related Art

At airports, boarding tickets (or boarding passes), for passenger planes are issued by ticket issuing devices. In a case where a plurality of airlines share the same ticket issuing device, the device is connected to the host computer of the airline having the next departure flight, so as to print on paper the name of the airline, the boarding date, the place of departure and destinations, the flight number, passenger seat number, and other boarding information (or ticket information) sequentially supplied from the computer as printing data, and issue the printed paper in the form of boarding tickets.

Conventionally, a ticket issuing device having a thermal head formed with a plurality of heat generating elements is known. The ticket issuing device prints the boarding information on paper formed of ordinary paper material in combination with a heat transfer ribbon coated with fusible ink. When the heat generating elements of the thermal head are selectively driven to perform a printing operation, the fusible ink is partly melted by heat generated from the driven heat generating elements and transferred from the heat transfer ribbon to the paper. Fusible ink is superior to liquid ink as regards its quick-drying property, and therefore there is no possibility of the passengers hands or clothes being stained by the boarding tickets issued.

In order to issue the total number of boarding tickets required in a short period of time, the issuing speed of the ticket issuing device is raised to maximum by increasing the energization power supplied to the heat generating elements and reducing the energization time. However, the temperature of the thermal head is raised by the heat generated from the heat generating elements as a result of the printing operation being effected repeatedly, and such temperature increase may degrade the printing quality. Therefore, the issuing speed is limited so as not give rise to an increase in temperature such as would degrade the printing quality, when the printing operation is being effected repeatedly so as to issue a quantity of boarding tickets corresponding to the number of seats of, for example, a large-capacity airliner.

The issuing speed of the ticket issuing device is set appropriately so as to print all the boarding information in the form of ordinary characters on ticket paper. With such a ticket issuing device, a problem occurs when a large part of the boarding information is printed in the form of picture on ticket paper so as to issue unique boarding tickets. That is, if most of the heat generating elements are more frequently driven as a result of an increase in the printing density, the thermal head will be heated to a temperature higher than in the case of the normal printing operation in which all the boarding information is printed in the form of ordinary characters. If the temperature of the thermal head rises significantly, the ticket paper will be stained by fusible ink melted by the heat coming from that portion of the thermal head around the heat generating elements, with the result that the characters will be printed having thicker lines and their contours will become unclear Moreover, the heat generating elements themselves may be damaged.

In order to solve the above problem, consideration has been given to the issuing speed being determined in the design process of the ticket issuing device appropriately, so as to print all the boarding information in the form of picture. However, the issuing speed will be lower than that in the conventional case.

SUMMARY OF THE INVENTION

An object of this invention is to provide a ticket issuing device in which the issuing speed can be kept high, except for the case wherein the printing density is increased significantly and degradation of the printing quality and the operation reliability due to such an increase in printing density can be prevented.

The above object can be attained by a ticket issuing device comprising a thermal head; a temperature detector for detecting the temperature of the thermal head; and a printing control circuit for driving the thermal head to repeatedly print ticket information on paper a number of times corresponding to the number of tickets to be issued, issuing the printed paper as tickets, deriving a temperature difference between the temperatures detected by the temperature detector before and after each printing operation as the rate of temperature increase of the thermal head, and delaying the next printing operation so as to allow the thermal head to cool when it is detected that the rate of temperature increase has exceeded a reference value set to be higher than the rate of the temperature increase which will occur in the course of the printing operation performed at normal printing density.

In the ticket issuing device, the rate of temperature increase of the thermal head is derived after each printing operation and is compared with the reference value. For example, the reference value can be set as a reference of the rate of temperature increase which may cause the thermal head to reach a temperature at which the printing quality and operational reliability tend to be degraded. Since the rate of temperature increase becomes lower than the reference value in each printing operation when the printing operation is effected at normal printing density, all the printing operations can be continuously effected if the printing preparation period such as time for replacement of ticket paper is neglected. Therefore, a high ticket issuing speed can be maintained until the final ticket is printed. In contrast, the rate of temperature increase will become higher than the reference value in each printing operation when the printing operation is effected at a high printing density, the time required to complete the issuing operation becomes longer due to the delay time during which the thermal head is set in the deactivated state. However, since the temperature of the thermal head drops during this time, the degradation in the printing quality and the operation reliability can be prevented. The delay time can be short since the thermal head is set in the nonactive state before it becomes overheated. Further, in the ticket issuing device, even when the printing density becomes partly higher, the desired number of tickets can be issued in a short period of time if the rate of temperature increase of the thermal head is kept below the reference value.

DETAILED DESCRIPTION OF THE PREFERRED EMBODIMENTS

There will now be described a ticket issuing device according to one embodiment of this invention with reference to FIGS. 1 to 5.

Figure 1:
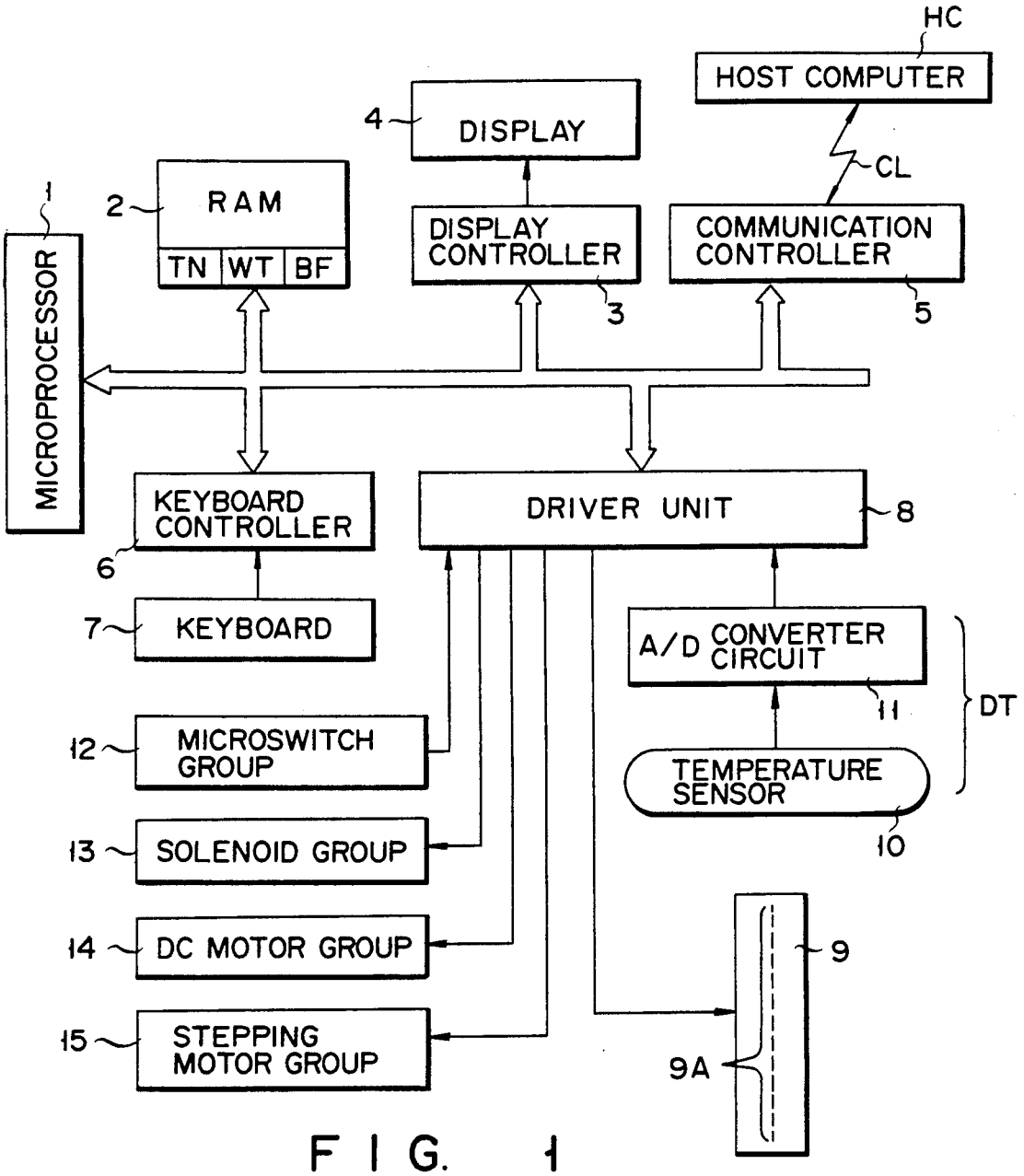
FIG. 1 is a circuit diagram of a ticket issuing device according to this invention.
Figure 2:
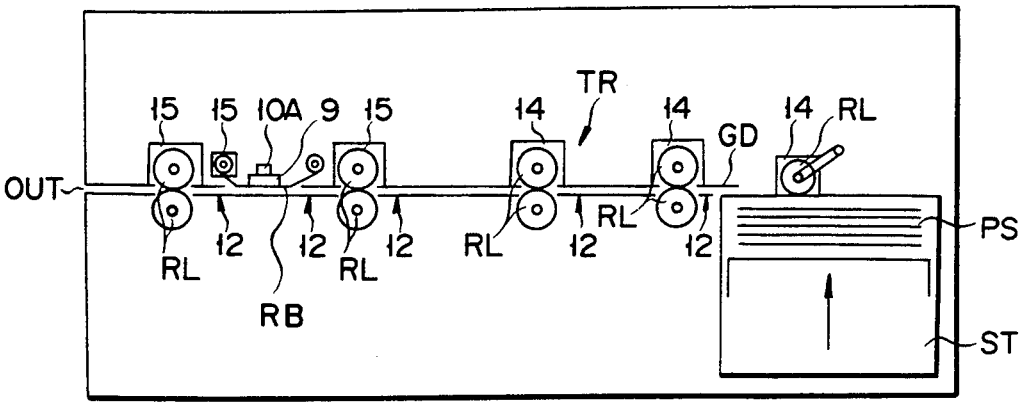
FIG. 2 is a diagram schematically showing the mechanism of the ticket issuing device.

FIG. 1 is a circuit diagram of the ticket issuing device, and FIG. 2 shows the mechanism of the ticket issuing device. The ticket issuing device is used for issuing boarding tickets for airliners in an airport. In a case where a plurality of airlines share the same ticket issuing device, the ticket issuing device is connected to host computer HC of a desired one of the airlines to sequentially receive boarding information such as the name of the airline, flight number and seat number supplied as printing data from host computer HC, print the received boarding information on paper PS and issue printed paper PS as boarding tickets.

The ticket issuing device includes microprocessor 1, RAM 2, display controller 3, liquid crystal display 4, communication controller 5, keyboard controller 6, keyboard 7 and driver unit 8. Keyboard 7 and display 4 are respectively connected to keyboard controller 6 and display controller 3 via exclusive lines and the remaining circuit elements are connected to each other via bus line BS including an address bus, data bus and control bus. Microprocessor 1 constitutes an independent computer having a control program stored therein. RAM 2 includes memory areas serving as ticket counter TN buffer BF for printing data of the boarding information and wait timer WT. Wait timer WT is a counter in which numeral data is set by microprocessor 1, and the count thereof is decremented by "1" at a regular interval in response to an internal clock signal of microprocessor 1. When a preset time corresponding to the preset numeral data has elapsed, the count of the counter becomes "0". Communication controller 5 is connected to host computer HC via communication network CL. The printing data of boarding information is supplied to communication controller 5 and stored in RAM 2 by microprocessor 1. Keyboard 7 is operated to input a ticket issuing command and other control commands to the ticket issuing device and the operation of keyboard 7 is detected by keyboard controller 6. Display controller 3 is used to control display 4 so as to display the operating condition of microprocessor 1.

Driver unit 8 is connected to thermal head 9, temperature detector circuit DT, microswitch group 12, solenoid group 13, DC motor group 14 and stepping motor group 15 and drive them to effect the printing operation based on the printing data stored in RAM 2. Thermal head 9 includes heat generating elements 9A arranged in a row. Heat generating elements 9A are driven according to the printing data supplied in the unit of a printing line from driver unit 8. Further, temperature detector circuit DT includes temperature sensor 10 for detecting the temperature of thermal head 9 and A/D converter 11 for converting an analog output signal of temperature sensor 10 into a digital signal and supplying the digital signal to driver unit 8.

DC motor group 14 and stepping motor group 15 are used to drive convey roller RL and take-up roller BL of heat transfer ribbon RB shown in FIG. 2, solenoid group 13 serves to drive motor groups 14 and 15, and microswitch group 12 serves to detect the position of paper PS supplied from stocker ST and moved along convey path GD by convey roller RL.

Figure 3:
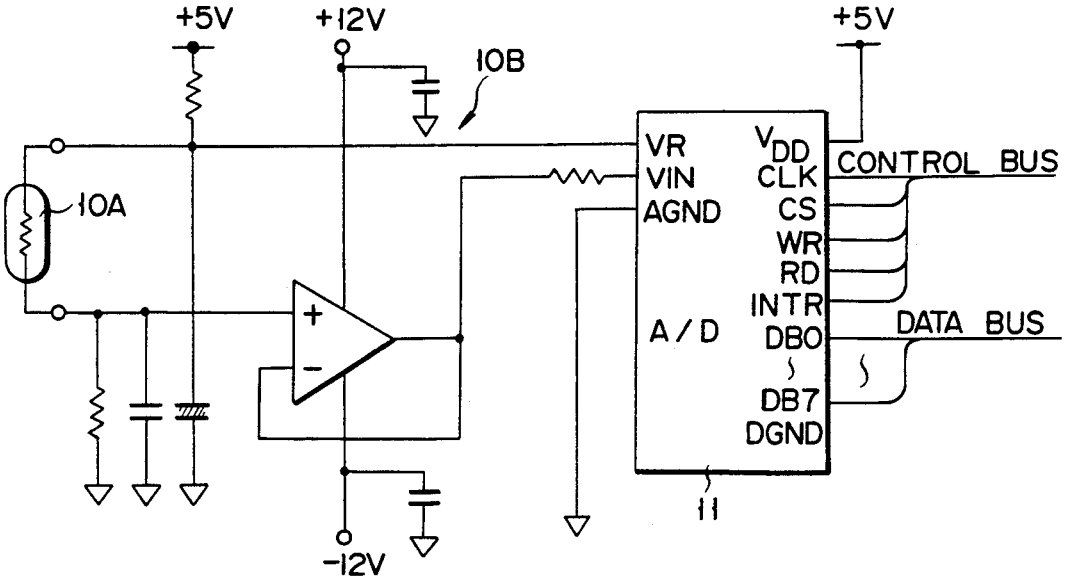
FIG. 3 is a circuit diagram showing a temperature detector of FIG. 1 in detail.

FIG. 3 shows temperature detector circuit DT in detail. Temperature sensor 10 includes thermistor 10A attached to the rear surface of thermal head 9 and operation amplifier 10B for amplifying an input voltage corresponding to the resistance of thermistor 10A and supplying the amplified voltage to A/D converter 11.

Figure 4:
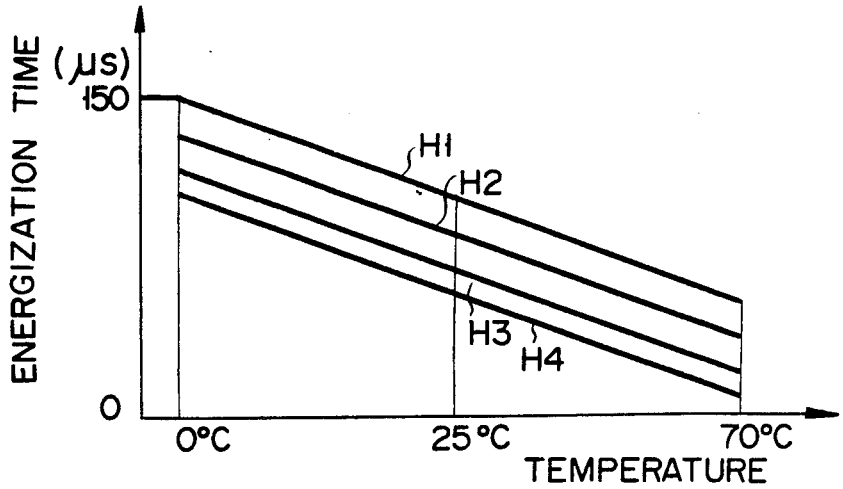
FIG. 4 shows the temperature-energization time characteristic of each heat generating element with the current conduction hysteresis used as a parameter.

FIG. 4 shows the relation between the temperature and the energization time of each heat generating element 9A with the energization hysteresis used as a parameter. The energization time of a heat generating element 9A is determined according to the energization hysteresis and the temperature of heat generating element 9A. When a dot is marked on paper PS by heat generating element 9A, the relation between the temperature and the energization time is shifted according to the energization hysteresis as shown by lines H1, H2 and H3. Line H4 indicates the relation between the temperature and the energization time in a case where heat generating element 9A is not driven to mark a dot on paper PS. Heat generating element 9A is kept activated according to line H4. This is intended to reduce the energization time required for transfer from a state in which heat generating element 9A is deactivated so as not to mark a dot on paper PS to a state in which heat generating element 9A is driven to mark a dot on paper PS.

Figure 5A:
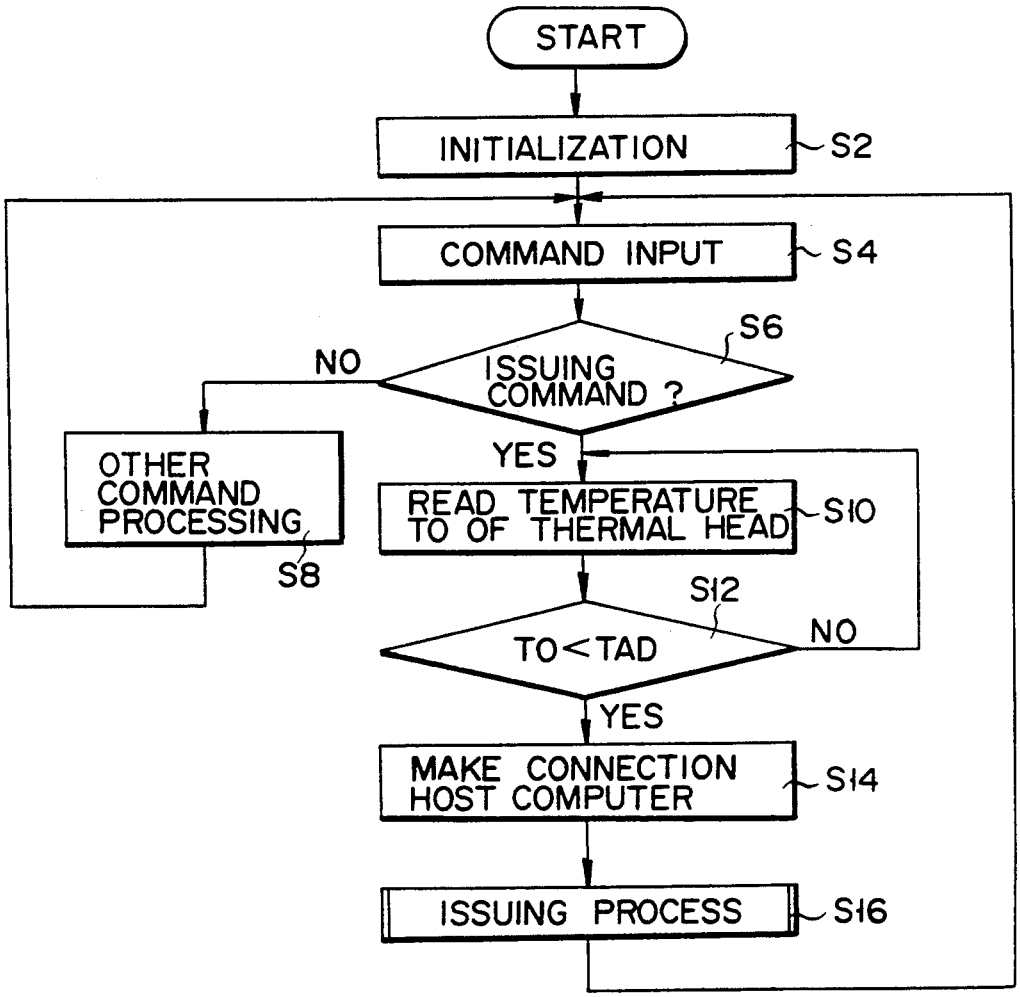
FIGS. 5A and 5B are flowcharts illustrating the operation of the ticket issuing device shown in FIG. 1.

Now, the operation of the ticket issuing device is explained with reference to FIGS. 5A and 5B.

The operation of the ticket issuing device is started by turning on the power source. First, an initialization is effected in step S2. If a command is input in step S4, it is checked in step S6 whether or not the input command is a boarding ticket issuing command. When it is detected that the input command is not the boarding ticket issuing command, another command process is effected in step S8 and then step S4 is effected again.

When the boarding ticket issuing command is detected in step S6, current temperature T0 of thermal head 9 is read from temperature detector circuit TD and stored in RAM 2. It is checked in step S12 whether or not temperature T0 is higher than preset value TAD which is set lower than maximum permissible value TMAX of thermal head 9. Maximum permissible value TMAX is an upper limit value of the temperature range of thermal head 9 within which the printing quality and operation reliability will not be lowered. In a case where temperature T0 is higher than preset value TAD, steps S10 and S12 are repeatedly effected until temperature T0 becomes lower than preset value TAD. If it is detected in step S12 that temperature T0 is lower than preset value TAD, communication controller 5 is connected to host computer HC of the airline in step S14 and then the boarding ticket issuing process is effected in step S16 shown in FIG. 5B. When a desired number of boarding tickets are issued in the ticket issuing process, step S4 is effected again.

When the boarding ticket issuing process is started, various control operations are effected as a printing preparation process in step S20 in the same manner as the conventional printing preparation process. In the printing preparation process, for example, printing data is received and set in driver unit 8 and at the same time paper PS is fed from stocker ST to a printing starting position near thermal head 9. Next step S22 is effected when each of various control operations is completed in step S20, and steps S20 and S22 are repeatedly effected until all the necessary control operations are completed. Even if all the necessary control operations are completed, it is determined in step S20 that the printing preparation is not yet completed if wait timer WT is still "ON" or in operation. When it is detected in step S22 that the printing preparation is completed, current temperature T1 of thermal head 9 is read from temperature detector circuit TD in step S24 and stored in RAM 2, and the printing process for one boarding ticket is effected in step S26. In the printing process, paper PS is moved from the printing-start position toward outlet OUT, and thermal head 9 is driven according to the printing data. The boarding ticket information is printed on paper PS while it is being fed in front of thermal head 9. After this, temperature T2 of thermal head 9 is read from temperature detector circuit TD in step S28 and stored in RAM 2. Printed paper PS is discharged from outlet OUT as boarding tickets. When it is detected in step S32 that the desired number of boarding tickets has been issued, communication controller 5 is decoupled from host computer HC and then the issuing process is over. However, if it is necessary to issue further boarding tickets, a difference between temperatures T2 and T1 is derived in step S32 by subtracting temperature T1 from temperature T2 and the result is used as temperature rise rate TC in the printing process. In step S34, temperature rise rate TC is compared with reference value $\alpha$ of the temperature rise rate. Reference value $\alpha$ is set to be higher than the temperature rise rate of thermal head 9 which will be obtained in the printing process with the ordinary printing density. Reference value $\alpha$ is set as the reference of the temperature rise rate with which the temperature of thermal head 9 will easily exceed maximum permissible temperature TMAX in the succeeding printing processes. When it is detected that temperature rise rate TC is higher than reference temperature rise rate $\alpha$, wait time TD1 is set as numeral data in wait timer WT in step S34. Wait time TD is previously determined based on reference value $\alpha$ to temporarily deactivate thermal head 9 for the shortest sufficient period. In next step S38, host computer HC is informed that wait timer WT is "ON", and then step S20 is effected again to effect the printing preparation process for the next boarding ticket. Further, when it is detected in step S34 that temperature rise rate TC is below reference value $\alpha$, step S20 is effected to effect the printing preparation process for the next boarding ticket.

In this embodiment, when the operator of the ticket issuing device operates keyboard 7 to input a boarding ticket issuing command, it is checked whether or not the temperature of thermal head 9 is within a temperature range suitable for the printing process. When the ticket issuing device is often used by the various airlines and the temperature of thermal head 9 is already set at a relatively high temperature, host computer HC is not connected until the temperature of thermal head 9 becomes lower than preset value TAD.

Further, when the issuing process is started, temperatures T1 and T2 of thermal head 9 are measured immediately before and immediately after each printing operation for the boarding ticket and temperature rise rate TC in the printing operation is compared with reference value $\alpha$. If the printing process is effected at normal printing density, temperature rise rate TC will not exceed reference value $\alpha$. In this case, all the printing processes are substantially continuously effected except the printing preparation period such as time for replacement of paper PS. Since the issuing speed is set to an adequate value for the printing operation with the ordinary printing density, all the boarding tickets can be issued in a relatively short period of time.

In a case where the printing process is effected with a higher printing density, temperature rise rate TC will exceed reference value $\alpha$ and thermal head 9 is deactivated for wait time TD1 before the next printing operation is started. As a result, the temperature of thermal head 9 is lowered to a value so as not to exceed maximum permissible temperature TMAX even after it is raised in the next printing process. In this way, the printing quality and operation reliability can be prevented from being degraded. In this case, the total ticket issuing time becomes longer according to the time for cooling the thermal head 9. However, if temperature rise rate TC does not exceed reference value $\alpha$, it is not necessary to deactivate and cool thermal head 9. Therefore, even when it is necessary to print part of paper with a higher printing density, all the boarding tickets may be issued in a relatively short period of time.

Further, the printing quality and operation reliability are not always degraded when the temperature of thermal head 9 has exceeded maximum permissible temperature TMAX. There are other factors which degrade the printing quality and operational reliability in association with the rise in the temperature of thermal head 9. Therefore, the temperature of thermal head 9 is allowed to temporarily exceed temperature TMAX.

This invention is not limited to the above embodiment, and can be variously modified without departing from the technical scope thereof.

Figure 5B:
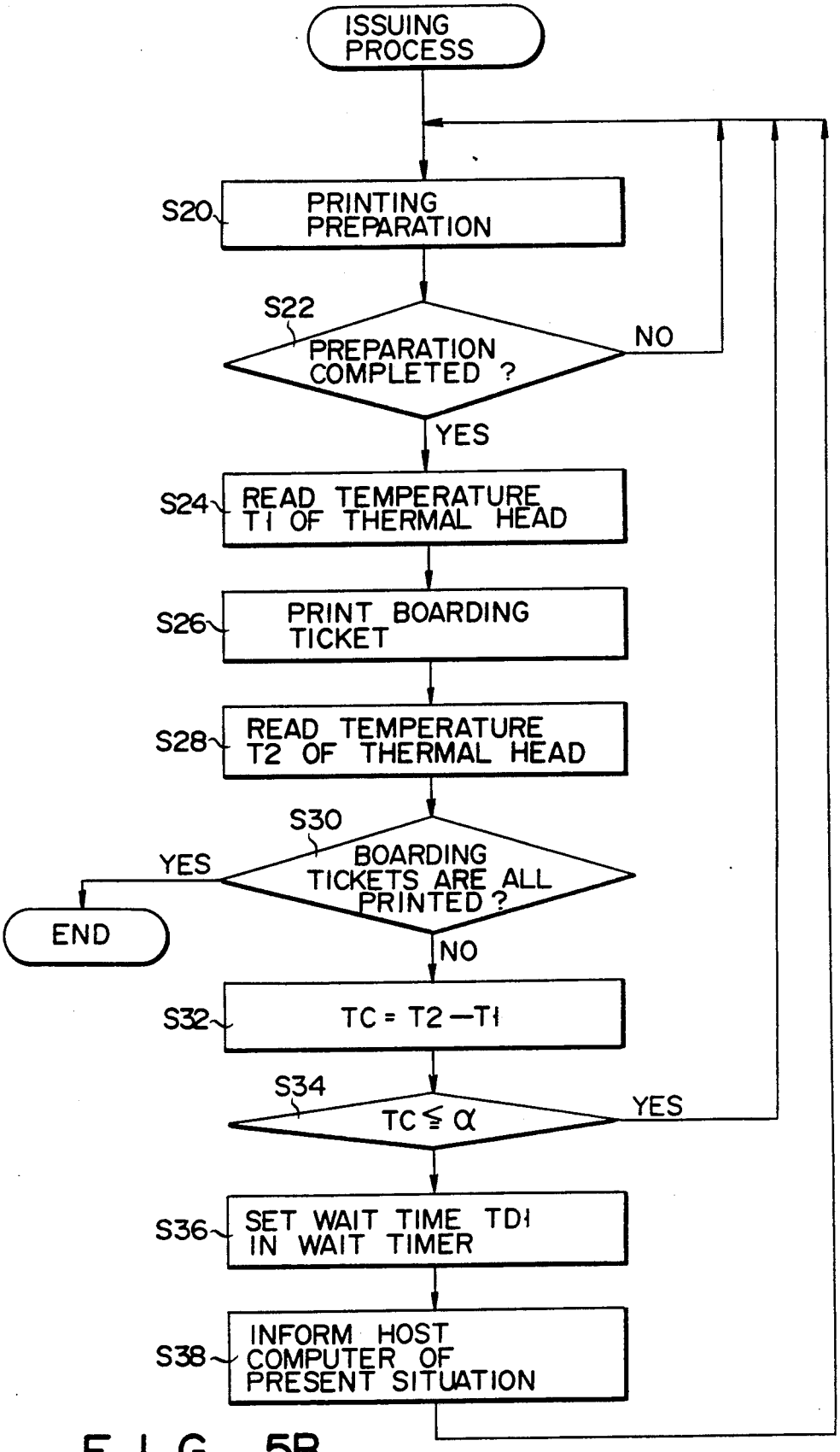
Figure 6:
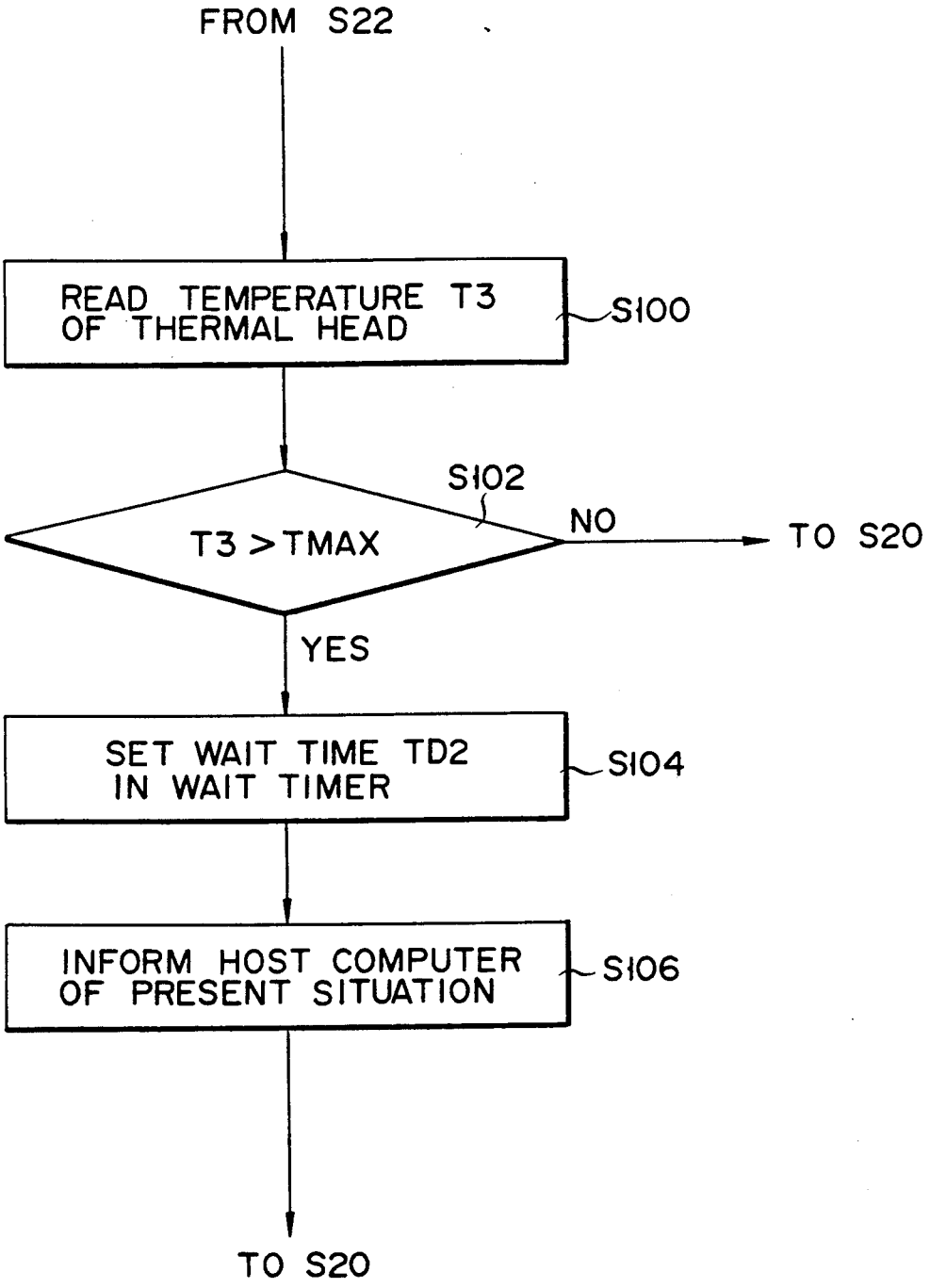
FIG. 6 is a modification of the flowchart shown in FIG. 5B.

In the above embodiment, step S20 is effected if step S22 shown in FIG. 5B is effected when paper PS is not set at the printing starting position in step S22 shown in FIG. 5B. At this time, for example, a process shown in FIG. 6 may be effected. In this process, temperature T3 of thermal head 9 is read by temperature detector circuit TD in step S100, stored in RAM 2, and then compared with maximum permissible temperature TMAX in step S102. If temperature T3 is below maximum permissible temperature TMAX, step S20 shown in FIG. 5B is effected in the same manner as in the above embodiment. However, when temperature T3 is higher than maximum permissible temperature TMAX, wait time TD2 is set as a numeral data in wait timer WT in step S104, and host computer HC is informed in step S106 that wait timer WT is "ON". After this, step S20 is effected again. Wait time TD2 is set to be longer than wait time TD1 in order to sufficiently lower the temperature of thermal head 9. In this way, the reliability of the card issuing device can be further enhanced. However, wait time TD2 may give a large influence on the boarding ticket issuing time and therefore it is necessary to pay much attention to the determination of wait time TD2.

In the above embodiment, wait timer WT is set in RAM 2 and the content thereof is updated by microprocessor 1 irrespective of the control program when wait timer WT is "ON". However, wait timer WT may be replaced by a wait timer constituted by an exclusive hardware formed outside RAM 2. In this case, the wait timer is connected as an I/0 device to microprocessor 1.

What is claimed is:

1. A ticket issuing device comprising:

a thermal printing head;

detecting means for detecting the temperature of said thermal head; and print control means including:

means for driving said thermal head to repeatedly print ticket information on paper a number of times, corresponding to the number of tickets to be issued;

means for issuing the printed paper as tickets; and means for deriving the rate of temperature increase of said thermal head corresponding to a temperature difference between temperatures detected by said detecting means before and after each printing operation, and for delaying the start of a next printing operation, and for delaying the start of a next printing operation, to allow said thermal head to cool, when it is detected that the derived rate of temperature increase has exceeded a reference value which is higher than a rate of temperature increase which will be attained in the printing operation at normal printing density.

2. A ticket issuing device according to claim 1, wherein said print control means further includes:

means for comparing the temperature detected by said detecting means during a printing preparation period of each printing operation with a maximum permissible temperature for said thermal head; and means for delaying the next printing operation, to allow said thermal head to cool, when the detected temperature exceeds the maximum permissible temperature.

3. A ticket issuing device according to claim 2, wherein said print control means further includes:

means for repeatedly comparing the temperature detected by said detecting means with a predetermined temperature lower than said maximum permissible temperature; and means for inhibiting an initial printing operation during a period in which the temperature of said thermal head is detected to be higher than said predetermined temperature.

4. A ticket issuing device according to claim 2, wherein said print control means further includes a wait timer means in which a wait time is present for inhibiting the next printing operation until said wait time is detected to have elapsed.

5. A ticket issuing device according to claim 4, wherein a wait time of a first value determined in accordance with said reference value is preset in said wait timer means when it is detected that the rate of temperature increase has exceeded the reference value.

6. A ticket issuing device according to claim 5, wherein a wait time of a second value determined in accordance with said maximum permissible temperature is preset in said wait timer means when the detected temperature exceeds the maximum permissible temperature.

7. A ticket issuing device according to claim 6, wherein said second value is longer than said first value.

* * * * *

UNITED STATES PATENT AND TRADEMARK OFFICE

CERTIFICATE OF CORRECTION

PATENT NO. : 5,059,044

DATED : October 22, 1991

INVENTOR(S) : K. TAKAISHI

It is certified that error appears in the above-identified patent and that said Letters Patent is hereby corrected as shown below:

Title page, below Section [76] Inventor, insert the following:

-- [73] Assignee: Tokyo Electric Co., Ltd.
Tokyo, Japan --

Signed and Sealed this

Twentieth Day of April, 1993

*Attest:*

*Attesting Officer*

MICHAEL K. KIRK

*Acting Commissioner of Patents and Trademarks*